US005655293A

United States Patent [19]

Celoudoux et al.

[11] Patent Number: 5,655,293

[45] Date of Patent: Aug. 12, 1997

[54] PROCESS AND APPARATUS FOR INSERTING WIRE ENDS INTO COMPONENTS AND APPARATUS FOR MANUFACTURING OF ELECTRICAL CABLE BUNDLES

[75] Inventors: Jean Paul Celoudoux, La Barque; Michel Verhille, Peynier, both of France

[73] Assignee: The Whitaker Corporation, Wilmington, Del.

[21] Appl. No.: 495,807

[22] Filed: Jun. 27, 1995

Related U.S. Application Data

[63] Continuation of Ser. No. 167,835, filed as PCT/FR92/00557, Jun. 19, 1992, abandoned.

[30] Foreign Application Priority Data

Jun. 21, 1991 [FR] France ..... 91 08131

[51] Int. Cl.[6] ..... H01R 43/20

[52] U.S. Cl. ..... 29/845; 29/33 M; 29/748

[58] Field of Search ..... 29/33 M, 33 F, 29/747, 748, 753, 845, 876; 72/155, 156; 140/1, 102; 198/345.3

[56] References Cited

U.S. PATENT DOCUMENTS

| | | | |
|---|---|---|---|
| 3,939,552 | 2/1976 | Hart et al. | 29/748 X |
| 4,330,927 | 5/1982 | Wolfthal | 29/753 X |
| 4,375,229 | 3/1983 | Mikami et al. | 140/102 |
| 4,380,117 | 4/1983 | Brandewie et al. | 29/747 X |
| 4,552,260 | 11/1985 | Teagno et al. | 198/345.3 |
| 4,622,733 | 11/1986 | Fukuda et al. | 29/748 X |
| 4,630,353 | 12/1986 | Okazaki et al. | 29/753 X |
| 4,680,841 | 7/1987 | Schneider et al. | 29/33 M |
| 4,779,334 | 10/1988 | Boutcher, Jr. | 29/748 |
| 4,825,537 | 5/1989 | Berry et al. | 29/876 X |
| 5,315,756 | 5/1994 | Jurjevic et al. | 29/748 |

FOREIGN PATENT DOCUMENTS

| | | | |
|---|---|---|---|
| 0359686 | 3/1990 | European Pat. Off. . | |
| 0429943 | 5/1991 | European Pat. Off. . | |
| 1197982 | 8/1989 | Japan | 29/748 |
| 2278792 | 12/1994 | United Kingdom | 29/753 |

*Primary Examiner*—Peter Vo
*Attorney, Agent, or Firm*—Dvorak and Orum

[57] ABSTRACT

The present invention relates to a process and apparatus for inserting wire ends into components and an apparatus for manufacturing electrical cable bundles.

According to the invention an apparatus for inserting the ends (70) of wire sections (5) in openings (54*a*) of components (54) comprises a device which moves the components relative to the wire end held in the mating gripper (7) along a curved trajectory.

The relevant technical field is that of electrical cable bundles.

14 Claims, 13 Drawing Sheets

YY31
20
19
ZZ3
10
XX5
25
YY3
Δ
5
20a
20b
23
18a
11
25

25d
25a
α

YY32
21
21a
21b
22
12
ZZ8
10,11
25c
25b
L1
L2
F
VII
VIII
70
6
XX1

PROCESS AND APPARATUS FOR INSERTING WIRE ENDS INTO COMPONENTS AND APPARATUS FOR MANUFACTURING OF ELECTRICAL CABLE BUNDLES

CROSS-REFERENCES TO RELATED APPLICATIONS

This is an file wrapper continuation application based on U.S. application Ser. No. 08/167,835, filed as PCT/FR92/00557 Jun. 19, 1992, and entitled "Process and Apparatus for Inserting Wires Ends into Components and Apparatus for Manufacturing of Electrical Cable Bundles" now abandoned.

DESCRIPTION

BACKGROUND OF THE INVENTION

The present invention relates to a process and apparatus for inserting wire ends into components and an apparatus for manufacturing of electrical cable bundles.

The relevant technical field is that of electrical cable bundles.

The present invention relates more specifically to the automatic manufacturing of simple electrical bundles; the term simple bundles is taken to mean electrical bundles comprising around ten electrical components of different types into which the ends of wire sections are inserted and with a maximum of approximately twenty components per bundle; moreover, the present invention applies more specifically to cable bundles comprising electrical components each of which has a relatively limited number of openings, and more specifically to cable bundles comprising components in which the openings are arranged less than in three rows.

Different processes and apparatuses used to carry out certain operations involved in the manufacturing of electrical cable bundles are already known.

Patent application FR 2 636 494 (RICARD) describes processes and apparatuses designed to insert electrical wire ends into components.

According to this document, the components are fitted on a pallet which can move along two rectangular axes. An insertion head, located confronting the pallet, grips insertion gripper devices in which the wire ends are held; the insertion grippers being adapted to suit the shape of the crimped terminal on the wire end.

Patent application EP 302 804 (RICARD) describes processes and apparatuses for crimping wire ends onto connections; according to this document, the wire ends held by grippers conveyed along carrier strips aligned with one another are transferred from a first carrier strip to a second carrier strip by a manipulator arm fitted with at least one gripper device.

Patent application EP 305 307 (Automatisme et Robotique Appliquee) describes grippers fitted on automatic cable making machine carrier strips and designed to hold one or several wires; the grippers comprise in particular two pairs of claws separated by an intermediate space in which a piston is pushed towards the tip of the gripper by a spring.

The general problem is to find a process and apparatus for manufacturing electrical cable bundles from wire sections the ends of which have been previously prepared and/or stripped.

At present, there is no known process nor apparatus for manufacturing electrical cable bundles that will allow industrial implementation; the processes and apparatuses described in application FR 2 636 494 have a certain number of inconveniences; the machine described in this document is bulky and complex; the operations required in the process described in this document involve a great amount of handling of the wire sections and call for complex movements of the wire ends and the components in which the wire ends are to be inserted.

Moreover, documents EP 302 804 and EP 305 307 do not describe actual processes and apparatuses allowing insertion of the wire ends and hence the manufacturing of electrical cable bundles.

The problem is more specifically to find a process and apparatus for manufacturing cable bundles capable of delivering completed cable bundles and thus capable of ensuring rapid handling of the bundle once it has been manufactured from wire sections and components and which is also capable of rapidly inserting the wire ends into the openings in the components.

The problem is also to obtain simple devices which can achieve high production rates of electrical cable bundles.

The problem is also to find processes and apparatuses which can handle the bundles in-process and post-process up to the stage where the complete bundles can be bound and dispatched for utilization.

The solution to the problem consists in finding an apparatus for inserting the ends of wire sections in openings of components characterized in that it comprises a device which moves the components relative to the wire end held in the mating grippers along a curved trajectory.

It is of advantage that the curved trajectory is formed by an arc of a circle of radius R1 situated in a vertical plane containing the axis ZZ70 along which the wire end held in the claws of the mating gripper is oriented.

It is of advantage that the devices that move the components with respect to the ends of the wires comprise component moving devices such that during the movement of the component according to the curved trajectory, the component remains parallel to itself (in a fixed direction)

It is of advantage that the apparatus comprises an insertion device specific to a predetermined type of component, which comprises on at-least one lateral face at least one end guide for guiding and inserting a wire end in the opening of the component, which insertion device comprises a mobile plate which can be rotated about a vertical axis YYS, on which the component can be placed, and at least one compression spring with the vertical axis YY5 as thrust axis, which mobile plate includes a linear cylinder for clamping the component on the insertion device.

It is of advantage that the devices for moving the component comprise a horizontal mobile plate which is connected to a horizontal fixed plate by means of two parallel rods, each equipped with an articulation separated by a distance that is equal to the value of the radius, so as to form (side view) a deformable parallelogram It is of advantage that the insertion device and the clamping linear cylinder are mounted on an intermediate support which can rotate according to a vertical axis YY5 in relation to the mobile plate.

It is of advantage that the components of a predetermined type can be carried to the insertion device by means of of a feed guide which covers a horizontal axis ZZ61 and due to a feed device (such as an actuator) and to mobile devices that retain the component.

It is of advantage that the wire end guide comprises at least one guide face which is inclined at a Γ angle in relation to axis ZZ70, whose value is less than 45 degrees and preferably less or equal to 30 degrees.

The solution to the problem also consists in finding a process for inserting wire ends in openings of components comprising the following operations:

a—an apparatus according to the invention;

b—a wire is placed in the claws of a mating gripper, c—the mating grippers are moved so as to position the end of the wire in a vertical plane containing the axis of the opening of the component which is held in a mobile insertion support;

d—the component and the mobile insertion support are made to follow a curved insertion trajectory, preferably holding the component on a parallel plane to a fixed direction.

It is of advantage that in operation d, the end of the wire comes into contact with a median zone (a median point) of the guide face when a point related to the component reaches the apogee of the curved trajectory, and then insertion movement is continued according to the curved trajectory.

The solution to the problem also consists in finding an apparatus for manufacturing electrical cable bundles comprising a first horizontal linear carrier strip of axis XX1, which can move transfer grippers, each pair of adjacent transfer grippers capable of holding a wire section; the apparatus comprises a second horizontal linear carrier strip which can move support grippers, the apparatus comprising at least two mating grippers each of which can extract from the transfer grippers and the support grippers and can introduce into the support grippers ar least one wire end; the mating grippers can move along a guide rail of axis XX4 parallel with the axis (XX1) and the apparatus comprises a device which moves the components relative to the wire ends held in the mating grippers along a curved trajectory which is contained in a plane perpendicular to the axis XX1

The apparatus also comprises at least one wire end gathering gripper with at least one sweep arm; the gathering gripper can move along the guide rail independently of the movements of the mating grippers on this guide.

Due to the movement devices and according to the curved trajectory it is possible in a simple manner with the same devices, to align the opening with the wire end to be inserted in the opening at the end of the curved insertion trajectory and it is also possible to set a vertical offset between the axis of the wire end to be inserted and the axis of the opening into which the wire end is to be inserted, at a point during the the trajectory corresponding to the start of the insertion operation itself, i.e. on contact between the wire end and the front part of the opening or preferably a guide placed in front of the opening and used to guide the wire end into the opening.

One of the very important advantages of the invention is that it makes it possible to have an apparatus that inserts wire ends in very compact openings and which integrates the mechanisms required for the insertion movement of the component, the clamping mechanism of the component during the insertion operations, the positioning mechanisms according to a predetermined position thanks to devices adapted to each type of component, as well as the wire end guide devices for guiding the wire ends into the openings of the components during the insertion phase itself, and the devices used to evacuate the component after it has been equipped with all the wire ends to be inserted into its openings.

Moreover in the event that one of the components comprises openings in which the wire ends are to be inserted, which are arranged on different sides of the component, the wire ends can be inserted on the component on several of its sides thanks to the intermediate support which is mounted rotating in relation to the mobile plate.

Moreover the processes and apparatusses according to the invention make it possible to carry out the different operations for inserting the wire ends in the openings of electrical components at a very fast rate in the restricted space found along a carrier strip transporting the wire section ends.

BRIEF DESCRIPTION OF THE DRAWINGS

The numerous advantages of this invention will be more readily understood from the description below which refers to the drawings in the appendix which provide a representation with no limitation of the specific modes of embodiment of an apparatus for the manufacturing of electrical cable bundles according to the invention.

DETAILED DESCRIPTION OF THE PREFERRED EMBODIMENT

Figure 1:
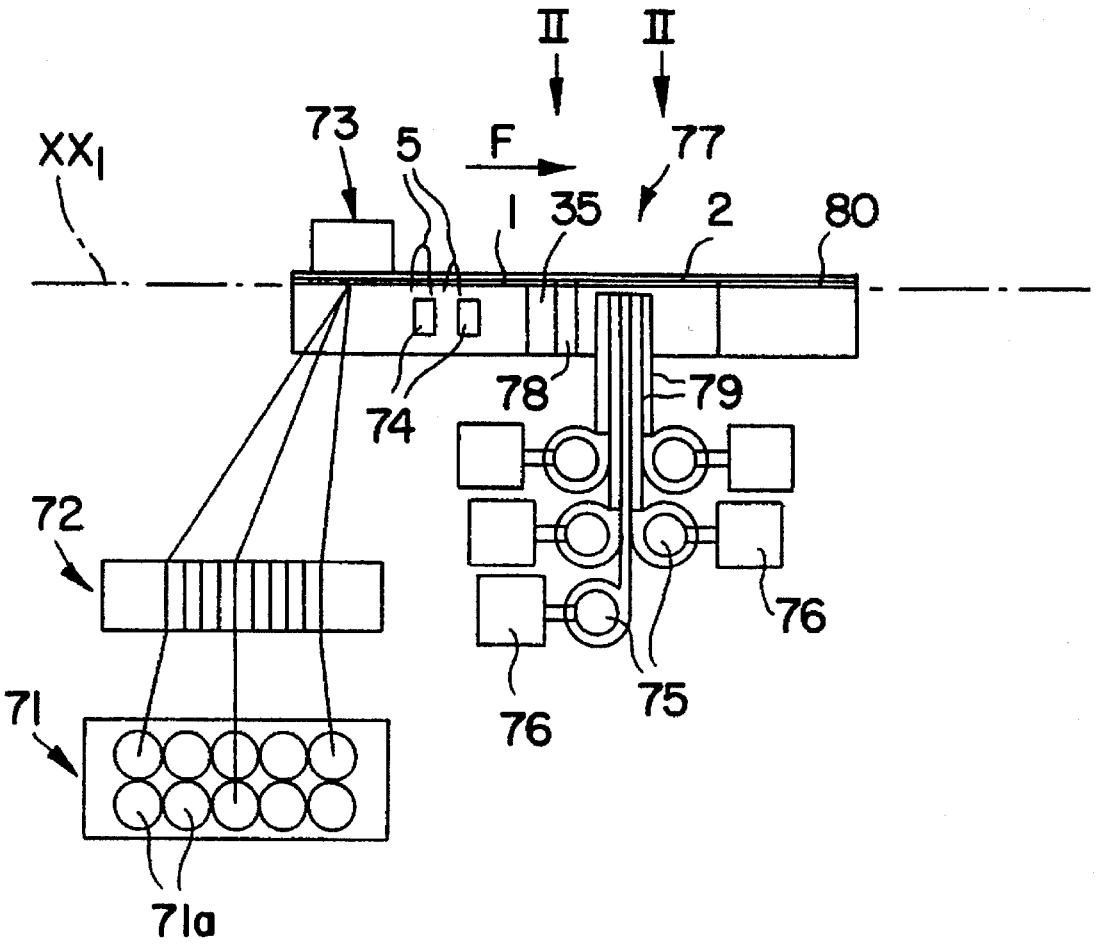
FIG. 1 shows a schematic plan view of the main components of an apparatus for manufacturing electrical cable bundles according to the invention.

FIG. 1 shows that an apparatus for manufacturing electrical cable bundles according to the invention comprises at least one carrier strip 1 oriented along a longitudinal axis XX1, at least one second carrier strip 2 oriented along the projected plane of the first carrier strip 1, and preferably comprises at least one fourth carrier strip 80 which is oriented along the projected plane of the second carrier strip 2; this figure shows that it is of advantage that an apparatus for manufacturing electrical cable bundles also includes a means 71 of storing electrical wires which can include several spools 71*a* round which the electrical wires which may be of different sizes and types are wound; the electrical wire supplied by each of these spools can be directed by means of at least one guide 72 towards a station 73 which selects the wire types and cuts the electrical wires into sections; downstream the wire section cutting and selection station 73, the wire sections S can be transferred onto the first carrier strip 1 by transfer grippers (not shown) such that the wire ends can be moved successively to wire end preparation stations 74 such as wire end stripping stations and/or stations for crimping connections onto the wire ends.

As shown, it is of advantage that downstream the preparation stations (i.e. in the general direction of movement of the wire sections along the electrical cable bundle manufacturing apparatus in the direction of arrow F), the apparatus comprises a wire section vertical positioning device 35 and then comprises, following the direction of movement, a device 78 for transferring the transfer grippers onto a third carrier strip (not shown); the figure shows that the wire sections which have been previously prepared and/or stripped at the stripping stations 74 are then transferred to a station 77 where the wire sections are assembled with the components (not shown) in order to produce the electrical cable bundles; the figure shows that the assembly station comprises the second carrier strip 2 and a component feed device 79 oriented perpendicular to the longitudinal axis XX1 of the electrical cable bundle manufacturing apparatus, the feed device being supplied with components through magazines 76, each of which is loaded with a predetermined component type, and through vibratory hopper feeders 75 for example which can set the components to a predetermined position on the feed device 79.

Figure 2:
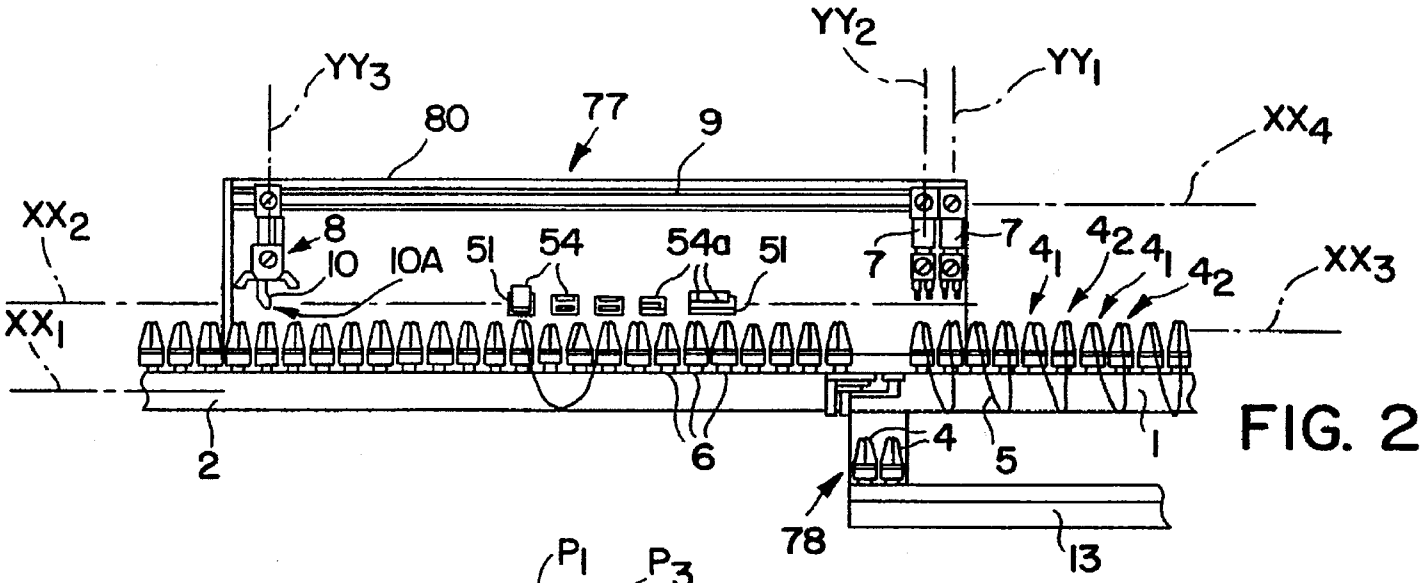
FIG. 2 shows a longitudinal side view of the main components of an electrical cable bundle assembly station according to the invention.

FIG. 2 is a view on II—II of FIG. 1 and shows a preferential mode of embodiment of an electrical cable bundle assembly station according to the invention.

This figure shows that the apparatus comprises the first carrier strip 1 which conveys the transfer grippers 41, 42, each pair of adjacent transfer grippers 41, 42 conveying a wire section 5 which is held in the claws of the transfer grippers.

It is of advantage that the transfer grippers are the grippers as described in patent application EP 305 307.

The figure shows that the first carrier strip 1 is oriented along a horizontal longitudinal axis XX1 and that a second linear carrier strip 2 is oriented along the projected plane of the first carrier strip, being capable of conveying support grippers 6 holding one or several wire section ends; the electrical cable bundle assembly station comprises two mating grippers 7 oriented along vertical axes YY1 and YY2 respectively and which can move along a horizontal axis XX4 parallel to axis XX1 on a rail or support 9 which runs the entire length of the assembly station 77; the figure shows that the components 54 delivered by the feed devices (not shown) can be brought close to the second carrier strip such that at least one of their faces with openings 54*a* into which the wire section end are to be inserted is located confronting the wire ends, each component of a predetermined type to be included in the electrical cable bundles being placed on a mobile insertion support 51 (shown schematically in this figure).

The figure shows that it is of advantage that all the openings 54*a* of the components used to manufacture the electrical cable bundles of a predetermined type are located at the same height, along an axis XX2 located at a predetermined height relative to the axis XX1 known as the insertion height.

The electrical cable bundle manufacturing apparatus and more specifically the assembly station 77 comprises at least one gathering gripper 8 oriented along a general vertical axis YY3 and which can move along the horizontal guide or support 9 independently of the movement of the mating grippers 7.

The figure shows that gathering gripper 8 is fitted with a sweep arm 10 the lower end of which is fitted with a jaw located at the so-called insertion height, which corresponds with horizontal axis XX2, such that when the gathering gripper 8 moves in the horizontal direction, the jaw at the lower end of the sweep arm 10 moves along axis XX2, i.e. at the insertion height, and thus can gather or approach the wire ends which have previously been inserted into the openings in one of the components.

The figure also shows that it is of advantage that the apparatus comprises a device 78 for transferring the transfer grippers 4 from the first carrier strip 1 onto a third carrier strip 13 which is preferably a horizontal linear carrier strip located below the first carrier strip 1.

Figure 3:
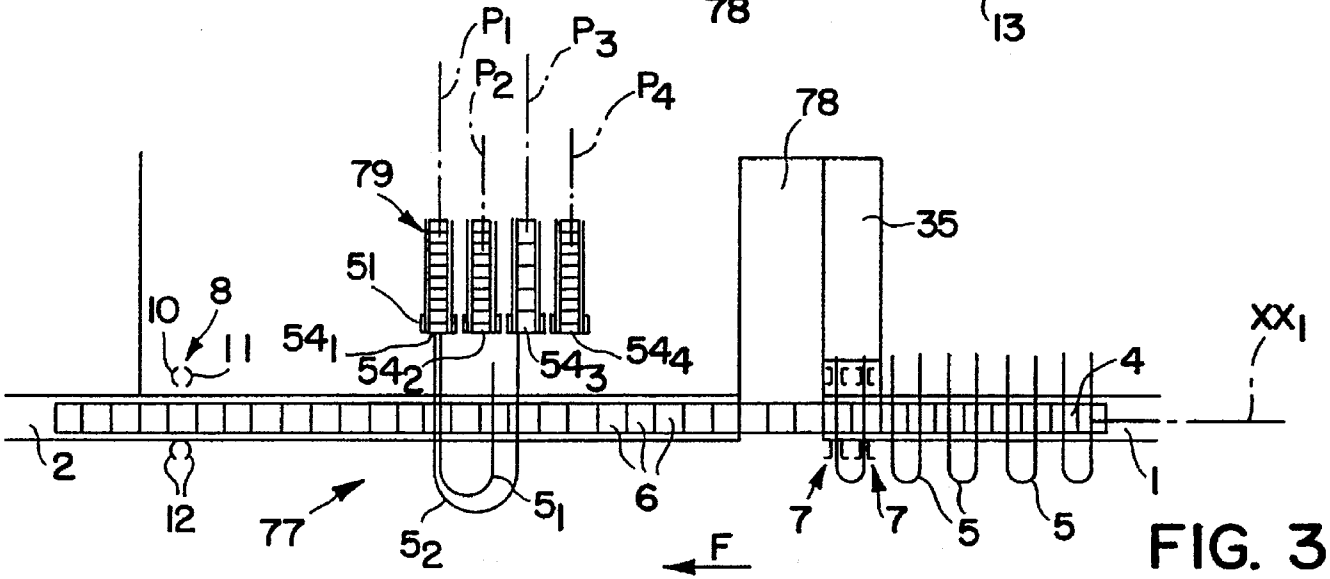
FIG. 3 shows a schematic plan view of the main components of an electrical cable bundle assembly station according to the invention.

FIG. 3 shows a schematic plan view of an electrical cable bundle assembly station 77; it shows that the electrical cable bundle manufacturing apparatus comprises successively, following the direction of movement along the arrow F of the electrical wire sections and the electrical cable bundles, the first carrier strip 1 which conveys the transfer grippers 4 holding the ends of the wire sections 5, the device 35 for vertical positioning of the two wire ends of a wire section held by the ends of the transfer grippers situated furthest downstream the apparatus, the second carrier strip situated on the projected plane of the first carrier strip and which conveys the support grippers 6 and the mating grippers 7 each of which is fitted with four claws represented respectively in this figure by a square bracket ([or]) and at least one gathering gripper 8 fited with the sweep arm 10, an internal articulated arm 11 and two external articulated arms 12 which are schematically represented by the symbol V (<or>). This figure also shows that on each of the feed devices 79 which can convey components of a predetermined type, a feed device 79 being provided for each different component type, the end located near the second carrier strip is fitted with a mobile insertion support 51 which can receive respectively a component $54_1$, $54_2$, $54_3$ or $54_4$; the figure shows that all the wire section ends are situated on the same side of the first and second carrier strips, and that the mobile insertion supports situated at the ends of the component feed devices are located on the same side of the carrier strips as the wire ends.

The gathering gripper comprises two arms 10 and 11 located on the same side of the second carrier strip as the wire section ends and comprises two arms 12 located on the other side of the second carrier strip, more precisely on the other side of the support gripper 6*s*; in order to differenciate in this document between the gripper arms some of which are located on the same side of the grippers (support 6 or transfer) as the wire ends and others located on the opposite side of the grippers, the term "internal" has been adopted for arms located on the same side of the grippers as the wire ends and the term "external" to indicate arms located on the opposite side from the wire ends relative to the grippers and more generally relative to the longitudinal axis XX1; this figure also shows that two wire sections 51 and 52 are located in the electrical cable bundle assembly station, each of the wire sections having one end inserted into an opening of component $54_1$, section 51 having a second end not inserted which is being held in one of the support grippers 6 and wire section 52 having a second end inserted into an opening in a componenet $54_3$. The figure also shows that the ends of the feed device 79 are oriented along planes P1, P2, P3, P4 which are perpendicular to the plane of the figure and perpendicular to the axis XX1 and in which, according to the invention, lies the curved trajectory of the component located at the end of the feed device and which forms the insertion trajectory for introducing the wire ends into the component openings.

Figure 4A:
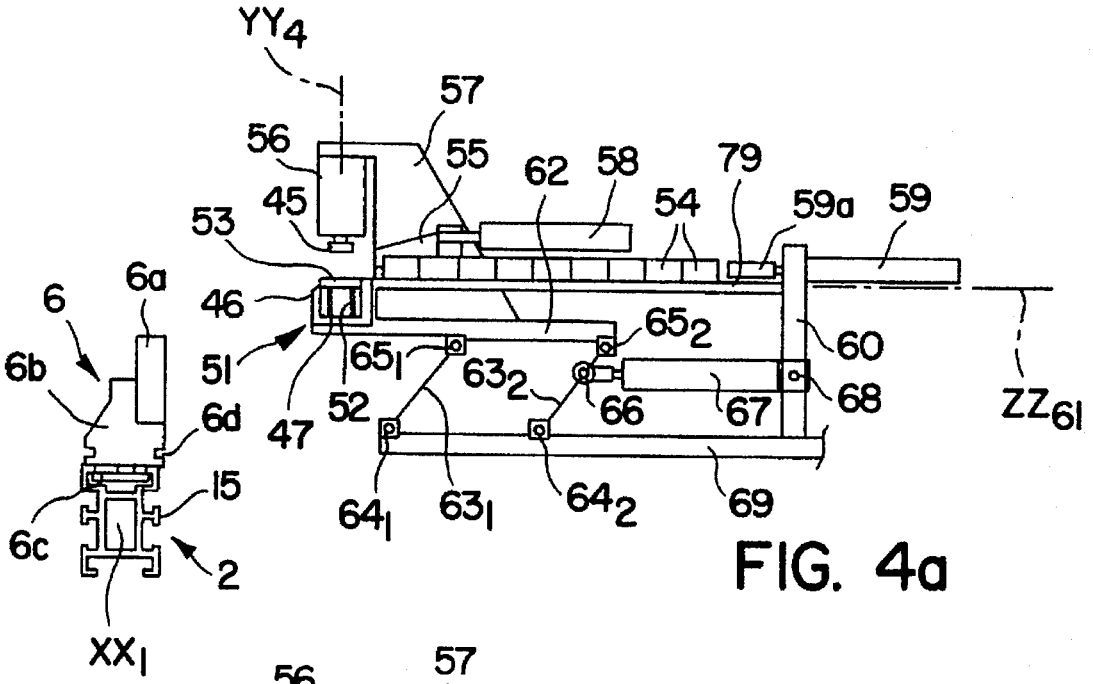
FIGS. 4*a* to 4*g* show a transversal view of a device for insertion of wire ends into components according to the invention and show the main operations involved in the insertion process according to the invention.

FIG. 4*a* shows a transversal view of the insertion device according to the invention and the schematic outline of a support gripper 6 conveyed by the second carrier strip 2 which is oriented along the axis XX1; it shows that in this mode of embodiment, the second carrier strip 2 comprises a support profile 15 and that it is of advantage that the support grippers are identical to the transfer grippers (not shown) and it is of advantage that they are as described in document EP 305 307; the figure shows that the upper part of support grippers 6 is fitted with claws 6*a* capable of holding the wire section ends and which are mounted on a gripper body 6*b*, the gripper body itself being mounted on a base plate 6*c* which can slide inside the support profile 15; the gripper body 6*b* is also fitted with lateral slots 6*d* used in particular to lock the support gripper 6 in position on the support profile 15 of the second carrier strip 2; the insertion device mainly comprises a mobile insertion support 51 mounted on a mobile deck 62, the mobile support 51 being fitted with a mobile plate 53 on which the components 54, conveyed on the component feed device 79, can be placed one by one.

The insertion support 51 consists of side walls 46 and a base 47 and mainly forms a hollow body inside which a compression spring 52 is fitted which rests against the base and supports the mobile plate 53 allowing it to move inside the hollow body of the mobile support 51 along a vertical axis YY4; the figure shows that above the mobile plate 53 of the insertion support 51 the end of a rod of a linear clamping cylinder 56 is fitted with a plunger 45, the clamping cylinder can be the pneumatic type for example and drives the plunger 45 along the vertical axis YY4; the clamping cylinder 56 is supported by a support or beam 76 which is attached to the mobile deck 62.

A component feed actuator 59 is equipped with a rod on the end of which is fitted a plunger 59*a* designed to push one or several components S4; the row of components 54 placed on the feed device 79 is retained at the end near the mobile insertion support by a stop 55 fitted on the end of a mobile stop cylinder 58.

The horizontal feed devices 79 oriented along an axis ZZ61 and the feed actuator 59 are held by a vertical support 60 which is attached to a horizontal fixed deck 69; the figure shows that the mobile deck 62 can be moved relative to the fixed deck 69 by articulated arms or links $\mathbf{63}_1$, $\mathbf{63}_2$, the ends of which are fitted respectively with articulations $\mathbf{64}_1$, $\mathbf{651}_1$ $\mathbf{64}_2$, $\mathbf{65}_2$, relating to the mobile and fixed decks respectively, these links or. articulated arms 63 being of the same length; the articulations allowing rotation of the links or arms relative to the decks along an axis perpendicular to the plane of the figure, such that the assembly constituted by the links and decks (in this side view) forms a deformable parallelogram; the figure also shows that one of the links $\mathbf{63}_2$ is connected through an articulation point 66 to the rod of an insertion cylinder 67 the body of which is attached through an articulation point 68 to the fixed support 60 on an axis perpendicular to the plane of the figure.

FIG. 4*a* illustrates the insertion device comprising the mobile insertion support 51 in a position in which no component is placed on the mobile insertion support.

Figure 4B:
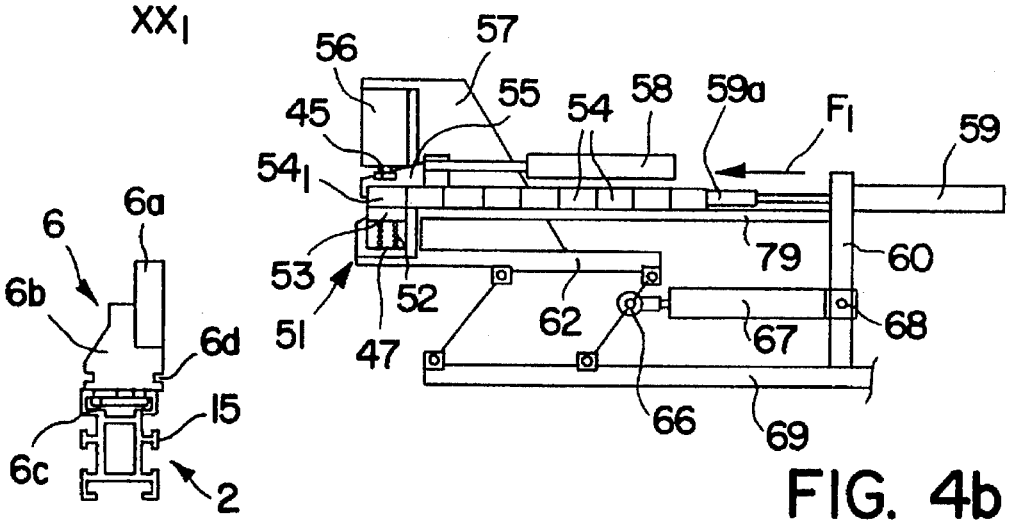

FIG. 4*b* shows the operation which places the component $\mathbf{54}_1$ located at the end of the row of components placed on the feed device is then pushed into position above the mobile plate 53 of the mobile insertion device, it being of advantage that this mobile plate is located along the projected plane of the feed guide; the figure shows that the component $\mathbf{54}_1$ is retained by the stop connected to the mobile stop cylinder and that the row of components is moved in the direction of the arrow F1 along the feed guide by the feed actuator 59 fitted with the plunger.

Figure 4C:
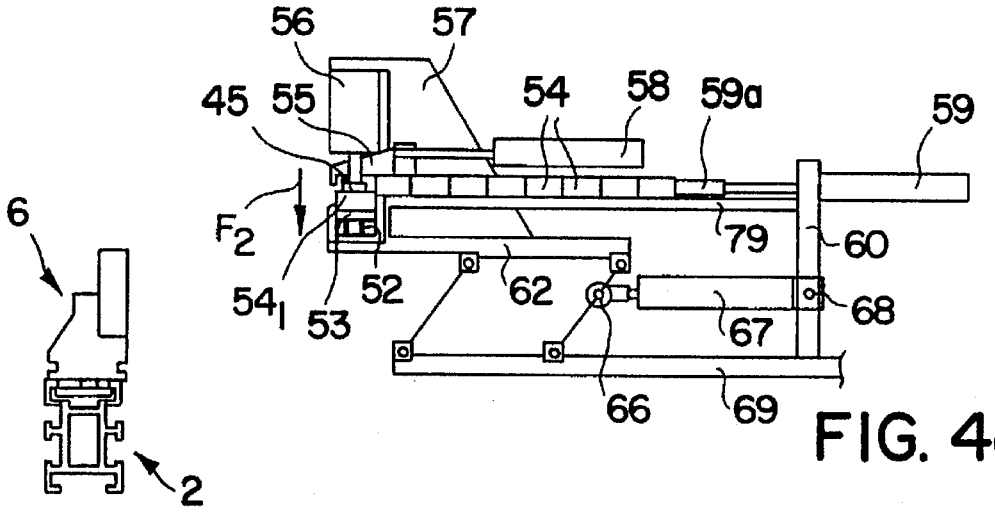

FIG. 4*c* shows the next operation in which the clamping cylinder 56 is actuated then drives the plunger in the direction of the arrow F2 which moves the component placed on the mobile plate 53 and the mobile plate itself, thus compressing the spring 52 to a predetermined position; it is of advantage that this predetermined position is such that, when the component reaches the apogee of the curved insertion trajectory, the openings in the component held on the mobile plate are positioned at the insertion height; it is of advantage that the mobile insertion support of which shape is adapted to suit the external shape of the component, allows the component to slide vertically, while the side walls of the mobile insertion support guide the component when it moves in the direction of the arrow F2.

The predetermined clamping position of the component on the mobile plate of the mobile insertion support is such that the openings in the components are located above the upper part of the support grippers.

Figure 4D:
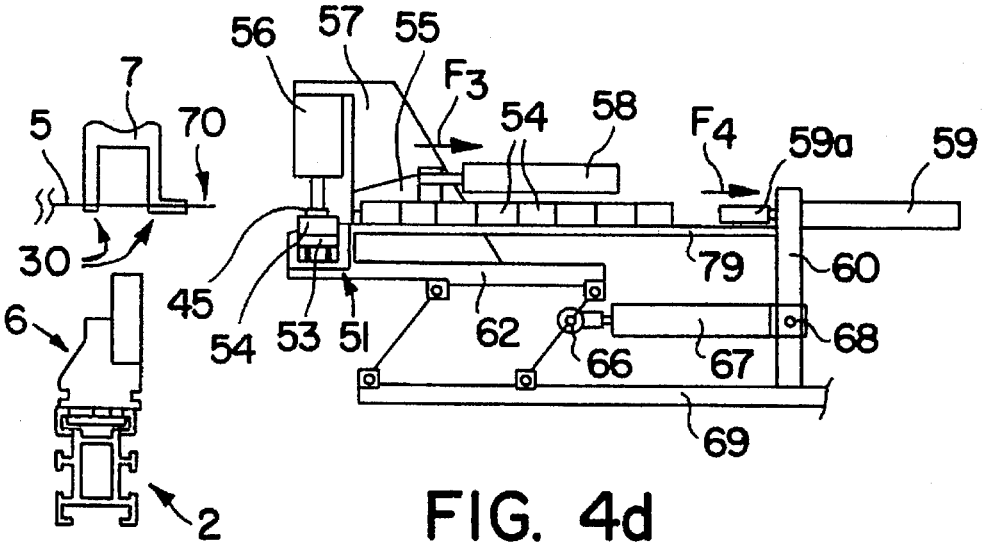

FIG. 4*d* shows the next operation in which one of the mating grippers (partially and schematically represented) is placed confronting the insertion device; the mating gripper is holding one prepared end 70 of a wire section 5 by its claws 30; after clamping of the component on the mobile plate of the mobile insertion support, the mobile stop 55 is moved in the direction of the arrow F3 by a return device fitted in the mobile stop cylinder so that it comes into contact with the front part of the next component in the row of components on the feed device; during this phase, the feed actuator plunger can return to its initial position by moving in the direction indicated by the arrow F4.

Figure 4E:
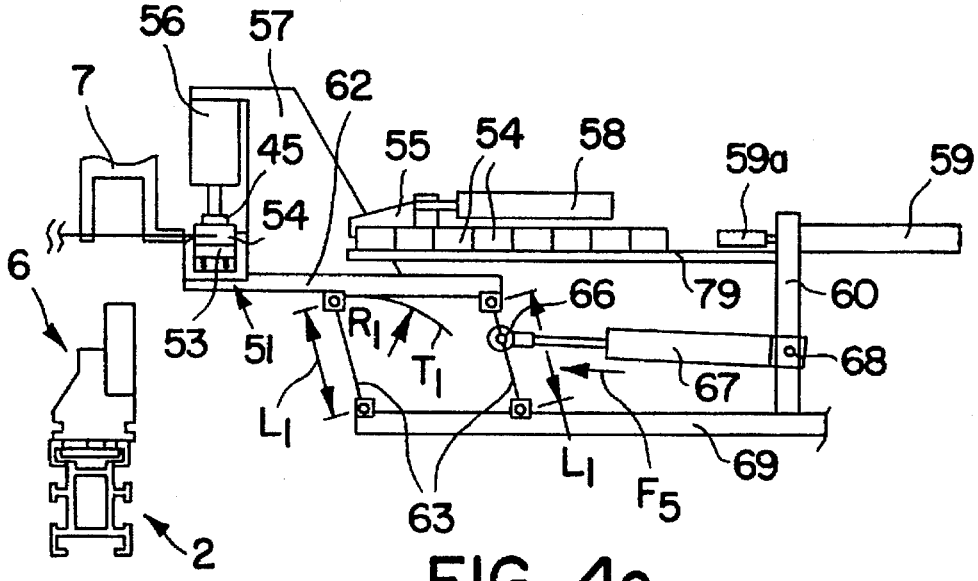

FIG. 4*e* shows the next operation, which is the actual insertion operation, in which the mating gripper 7 remains stationary while the mobile insertion support 51, the beam 57 and the mobile deck 62 are moved along a trajectory T1, in this case circular, by means of the insertion cylinder 67 which actuates the articulation 66 in order to rotate the links or arms 63 around the articulation point connecting the links to the fixed deck 69; the figure shows that in this particular mode of embodiment, the links, which free length L1 between their articulations is equal, this free length defining the value of the radius R1 of the trajectory T1 as an arc of a circle in the plane P perpendicular to the axis XX1 of the first and second carrier strips, The trajectory includes an upward phase followed by a downward phase at the end of which the end of the wire section held in the mating gripper is inserted into the opening in the component 54 clamped onto the mobile support 51.

Figures 1, 4F:
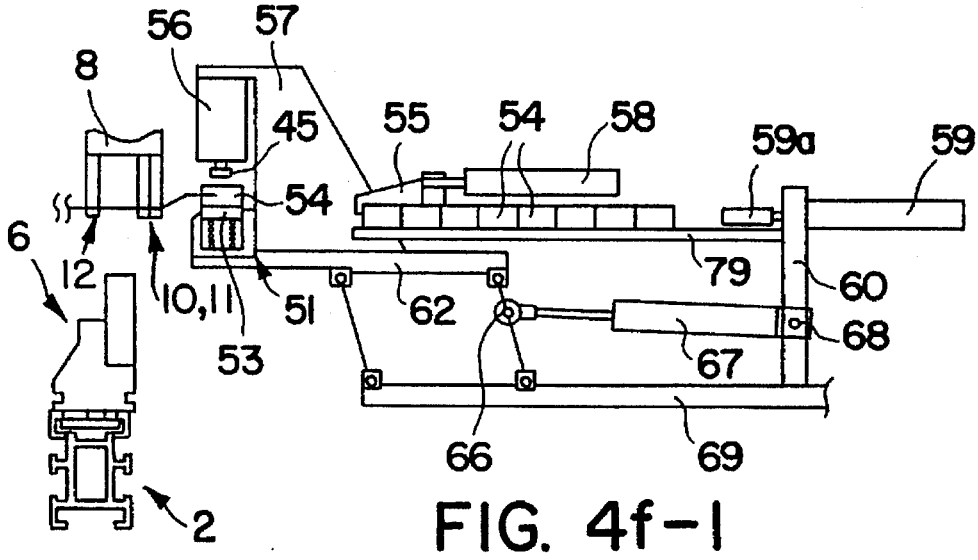
Figures 2, 4F:
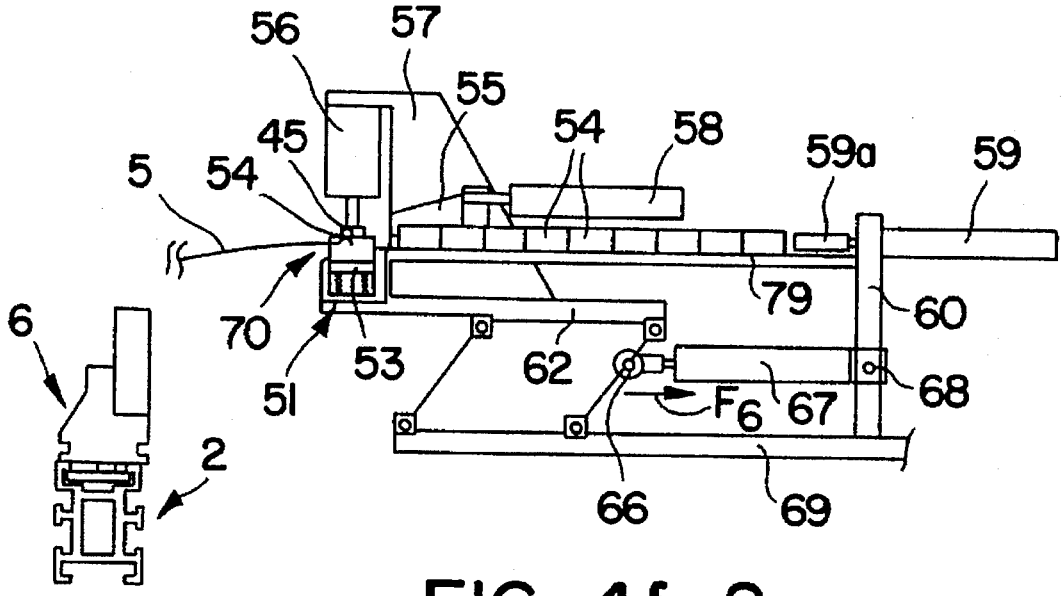

In the next operation, if all the openings of the component clamped onto the insertion support have had wire section ends inserted, then, as shown in FIG. 4*f*1, the gathering gripper 8 moves along the guide (not shown) into position confronting the insertion device, then the sweep arm 10, the internal articulated arm 11 and the external articulated arms 12 gather the wire section ends which have been inserted into the component openings; once the arms of the gathering gripper have closed, the component can be released by the clamping gripper as shown in FIG. 4*f*1, which causes the compression spring to trigger upwards movement of the component placed on the mobile plate of the mobile insertion support; alternatively, as shown in FIG. 4f2, if all the openings in the component 54 placed on the mobile insertion support have not had wire ends inserted, then following the operation shown in FIG. 4e, the mating gripper release the wire section which has been inserted into the opening in the component 54 then moves along the guide (not shown) to collect another wire end; as shown in FIG. 4f2, the end 70 of the wire section 5 which has been inserted into the component 54 then remains suspended from the end inserted into the component and the insertion cylinder moves the mobile insertion device back (from the second carrier strip) in the direction of the arrow F6 in order to allow another wire end to be delivered by a mating gripper (not shown on this figure), until the component 54 placed on the mobile insertion support has had wire ends inserted in all the required openings.

Figure 4G:
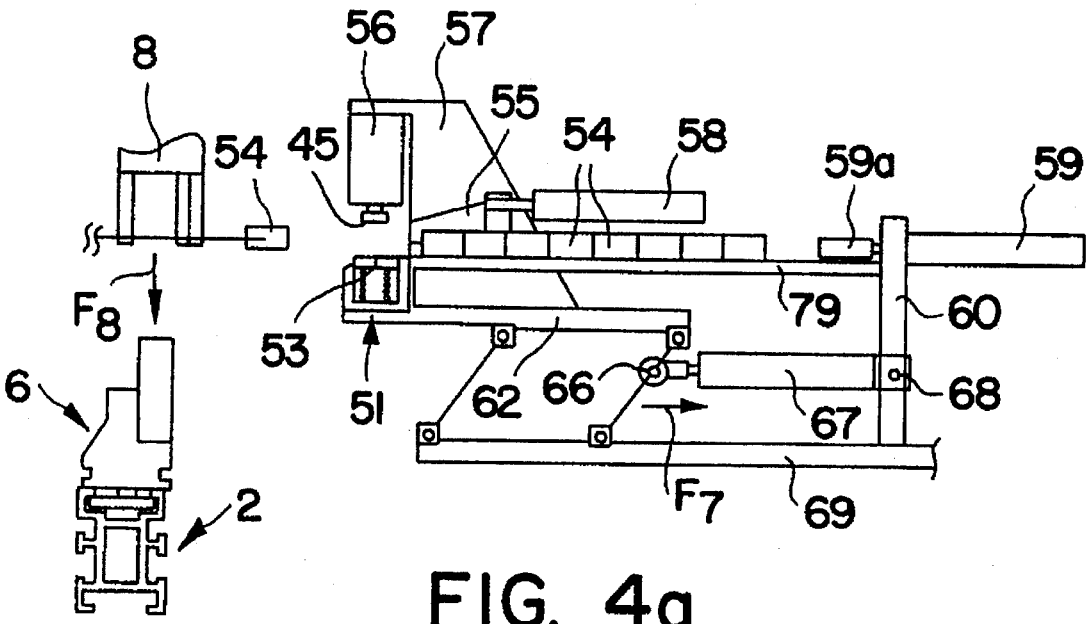

FIG. 4g shows the operation following the phase shown in FIG. 4f1, in which a component has had wire ends inserted in all its openings; the figure shows that the component 54 remains suspended from the wire ends which have been inserted into its openings, these wire ends being held by the gathering gripper 8 which can then move along the guide (item 9 in FIG. 2) in order to move into position confronting one of the support grippers and to move down in the direction of the arrow F8 in order to introduce the wire ends having been inserted into the suspended component 54 into the claws of a support gripper; this figure also shows that the insertion cylinder moves in the direction of the arrow F7 to retract the mobile insertion support from the second carrier strip along a curved, and in the case of FIG. 4g circular, trajectory identical to the insertion trajectory but in the opposite direction.

FIGS. 5a to 5f show a very schematic plan view of operations similar to those shown in FIGS. 4a to 4g, illustrating how to manufacture an electrical cable bundle by means of the process and apparatus according to the invention.

Figure 5A:
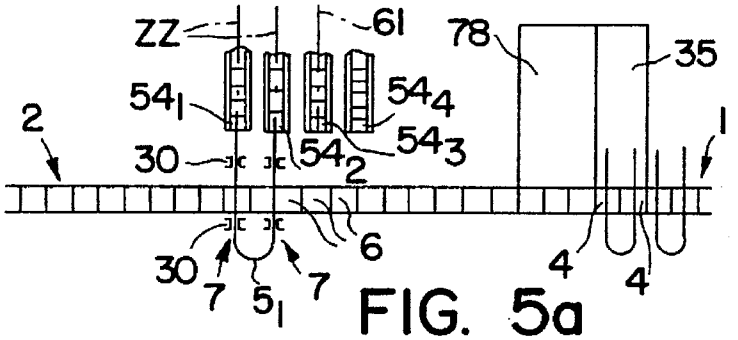
FIGS. 5*a* to 5*f* show a schematic plan view of the main operations involved in a process for manufacturing electrical cable bundles according to the invention.
Figure 5B:
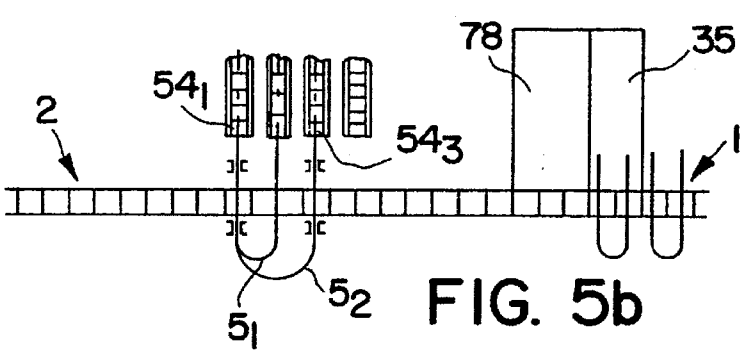

FIG. 5a which is similar to FIG. 3, shows the same vertical positioning device 35 for the wire section ends held in the transfer grippers 4 placed on the first carrier strip 1, the device 78 for transferring the transfer grippers from the first carrier strip to a third carrier strip (not shown) and the support grippers 6 placed on the second carrier strip 2 oriented along the projected plane of the first carrier strip; it also shows that four component feed devices are provided, each of which contains rows of identical components, with one component feed device being provided for each different component type; it is of advantage that the insertion devices, shown in FIGS. 4a to 4g but not shown in FIG. 5a to 5f to make for easier understanding, are identical and oriented along parallel axes which are preferably evenly spaced and as near as possible, for example about one hundred millimeters apart; in this way, for simple electrical cable bundles requiring not more than ten or twenty components of different types, it is possible to install ten or twenty similar insertion devices within an extremely restricted linear space (relative to the direction of movement of the wire sections and the electrical cable bundles along the carrier strips). FIG. 5a shows that a first wire section 51 has been gripped by two mating grippers 7, each of the mating grippers having four claws 30 shown on the figure by a square bracket. In the phase shown in FIG. 5a, each of the ends of the wire section 51 is held by the four claws of a mating gripper, two internal claws and two external claws; in this way, one end can be inserted into a first component, according to the process shown in FIGS. 4a to 4g, and the second end can be inserted into a second component $54_2$ placed on another insertion device. After insertion of the end of the wire section 51, the wire section remains suspended by its ends connected to the components $54_1$ and $54_2$ and as shown in FIG. 5b, the two mating grippers then grip the next wire section situated furthest downstream the first carrier strip and convey it along until one end of the second wire section 52 is confronting an opening in the component $54_1$ with the other end confronting an opening in a third component $54_3$ placed on a third insertion device.

Figure 5C:
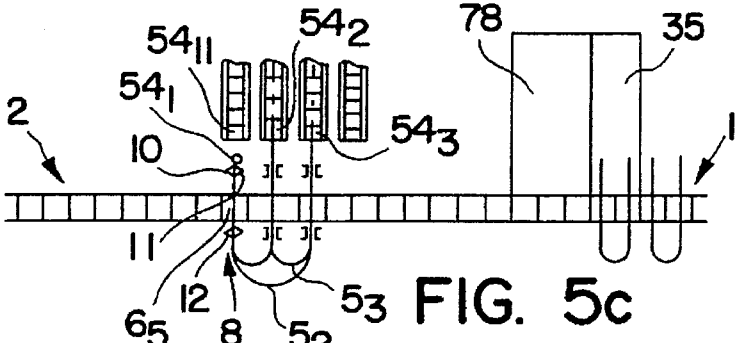

Following this operation as shown in FIG. 5c, the two mating grippers haved gripped a third wire section 53 and have placed one of the ends of this third wire section confronting the component $54_2$ and have placed the second end of the third wire section 53 confronting an opening in the component $54_3$, at the same time the gathering gripper has moved (from left to right on the figure) and by means of the sweep arm 10, the internal articulated arm 11 and the external articulated arm 12 has gathered the wire ends already inserted into the openings in the component $54_{11}$ this component $54_1$ having been released from the mobile insertion support by the clamping cylinder as shown in FIG. 4f1, which allows the gathering gripper to gather the wire ends and to introduce the wire ends into the support gripper 65 of the second carrier strip; this figure also shows that the component $54_{11}$ coming after the component $54_1$ in the row on the first feed guide (on the left hand side in FIG. 5c) has been positioned on the mobile insertion support (not shown) so as to be ready for insertion operations.

Figure 5D:
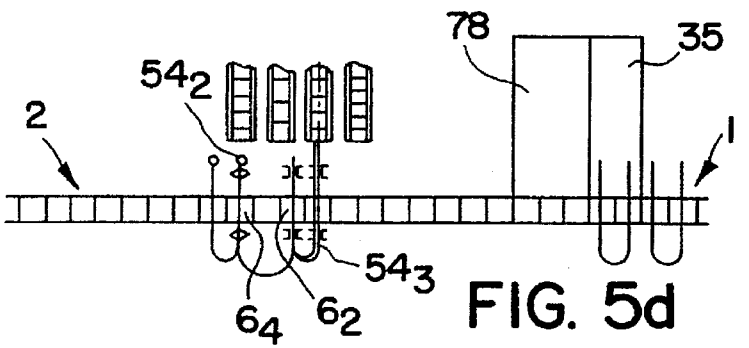

FIG. 5d shows that in the next operation, the gathering gripper (the sweeping and articulated arms of which are shown schematically using the symbol V) has gripped the wire ends which have been inserted into the component $54_2$ which is now completed, this component $54_2$ remaining suspended by the wire ends which have been inserted into the openings; these wire ends can be introduced into a support gripper 64 by the gathering gripper; this figure also shows that simultaneously, the two mating grippers have gripped a fourth wire section 54, one of the mating grippers (on the left in the figure) introducing one of the ends of the wire section 54 into one of the support grippers 62 on the figure, and the second mating gripper (on the right in the figure) allows insertion of the second end of the wire section 54 into an opening in the component $54_3$.

Figure 5E:
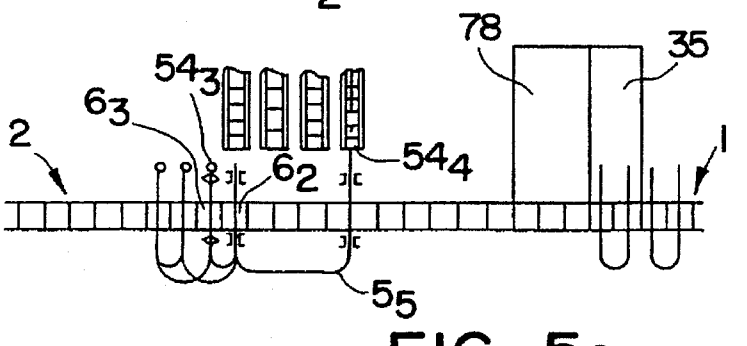

FIG. 5e shows that the gathering gripper has gripped the ends which have been inserted in the component $54_3$, this component $54_3$ having been released from the mobile insertion support then conveyed, suspended from its wire ends, by the gathering gripper which positions and introduces all the wire ends into a support gripper 63; simultaneously, the mating grippers have gripped a fifth wire section $5_5$, introduced one end of the wire section $5_5$ into the support gripper 62 and aligned the second end of the wire section $5_5$ with an opening in a fourth component $54_4$ placed on a fourth mobile insertion support and supplied by a fourth component feed device.

Figure 5F:
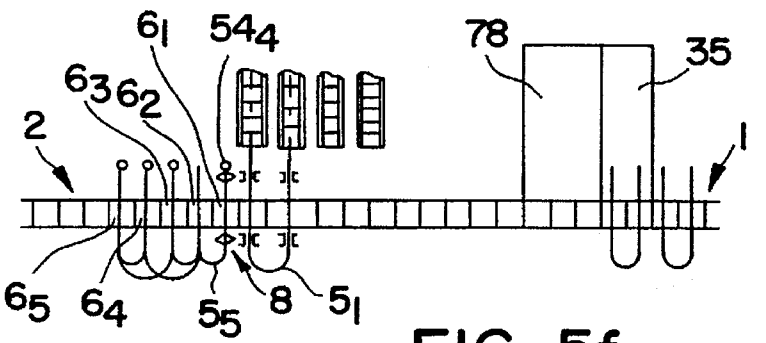

FIG. 5f shows the last operation of the process, in which the gathering grippers have gripped the end of the wire section 55 which has been inserted into the component $54_4$, which component $54_4$ has been released from the mobile insertion support; the gathering gripper has positioned and introduced the wire ends into one of the support grippers 61 on the second carrier strip; it also shows that during the operations shown in FIGS. 5a to 5f, the second carrier strip has advanced the support grippers such that, in FIG. 5f, a completed electrical cable bundle is being held in the support grippers 61, 62, 63, 64 and 65 of the second carrier strip and that, consecutively, the mating grippers have gripped a new first wire section 51 in order to resume the continuous manufacturing operations to produce a second electrical cable bundle identical to the electrical cable bundle which has just been completed, as shown in FIG. 5*a*.

Figures 6, 7A, 7B, 7C:
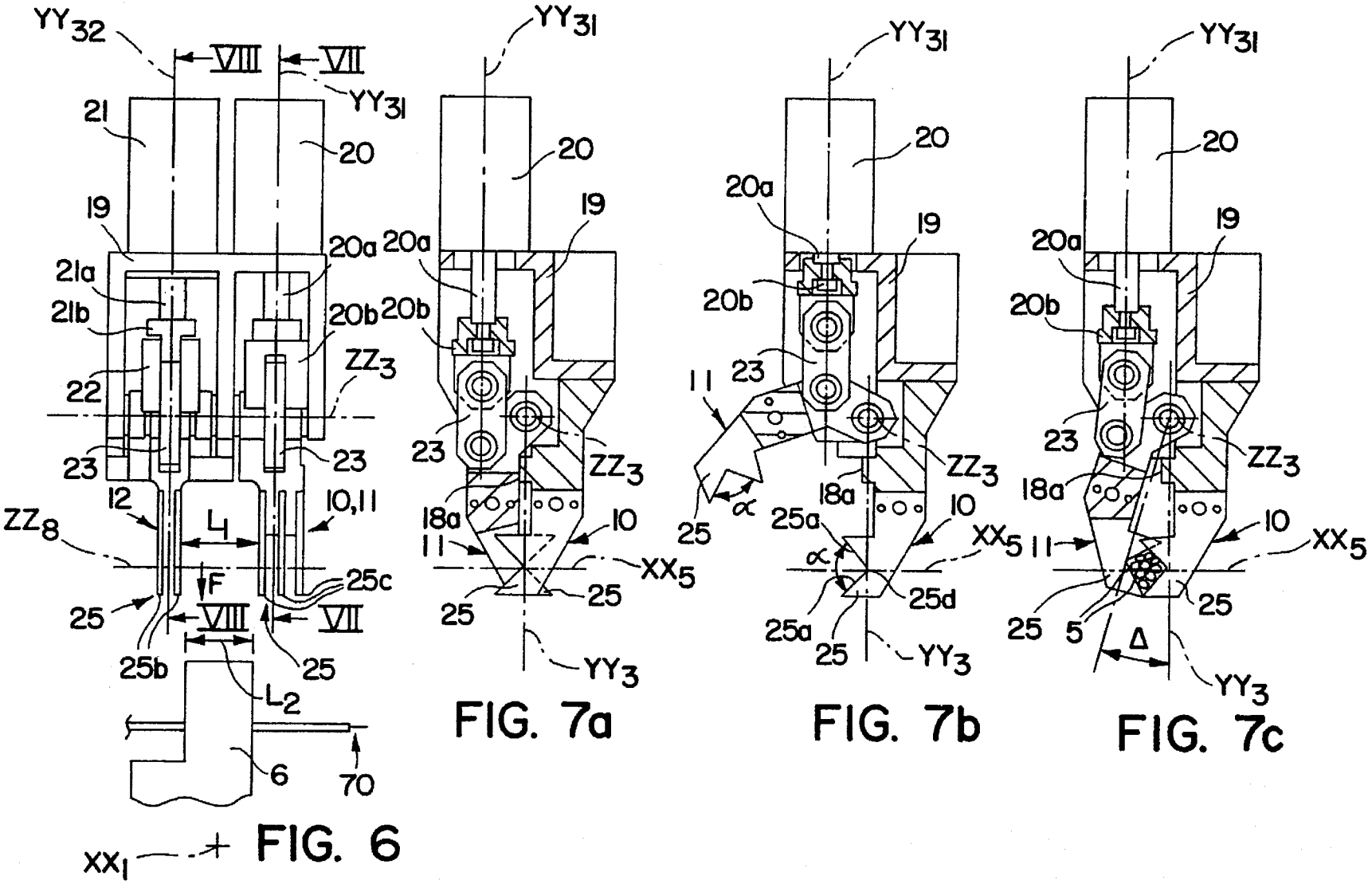
FIGS. 6, 7*a* to 7*c* and 8*a* to 8*c* show a gathering gripper for an apparatus for manufacturing electrical cable bundles according to the invention.

FIG. 6 shows a transversal side view of a gathering gripper according to the invention, i.e. a view along a direction parallel to the longitudinal axis XX1 of the first and second carrier strips.

FIG. 6 shows a gathering gripper comprising the sweep arm 10, the internal articulated arm 11 and the external articulated arms 12; the internal articulated arm and sweep arm are separated from the external articulated arm by a space of width L1 which is slightly larger than the width L2 of the upper part of the claws of the support gripper 6; this arrangement makes it possible, by also aligning the free space along the plane of FIG. 6 with the claws of the support gripper by moving the gathering gripper downwards in the direction of the arrow F, when the gathering gripper arms are holding one or several wire ends oriented along the axis ZZ8, to introduce the the wire end(s) into the claws of the support gripper located confronting the gathering gripper. The internal articulated arm 11 can be actuated by a first linear cylinder 20 by means of a rod 20*a*, a fork 20*b* and a link 23, this internal arm being articulated so that it rotates about an articulation axis ZZ3 which is preferably common to the internal articulated arm and the external articulated arms; the figure shows that, in the same way, the external articulated arms can be actuated by a second linear cylinder 21 through a cylinder rod 21*a*, a fork 21*b*, a beam 22 and links 23. FIG. 6 shows that the gathering gripper comprises a body 19 providing a support for the first and second linear cylinders and the articulation axis ZZ3.

FIG. 7*a* shows a partial sectional view on VII—VII of FIG. 6, in which the gathering gripper is shown with the internal articulated arm in the closed position, with no wire end held in the gathering gripper: it shows that it is of advantage that the sweep arm 10 which is rigidly attached to the gripper body or support 19 comprises a protruding stop 18*a* located on the main vertical axis YY3 of the gathering gripper, with this axis YY3 intersecting the articulated arms articulation axis ZZ3; the lower ends of the internal articulated arm 11 and the sweep arm 10 are fitted with a jaw 25, which jaws can slightly overlap when the arms are in a position where the gripper is closed; the figure also shows that with the articulated arm in this position, the articulated arm is at limit position against the stop 18*a* fitted on the rigid sweep arm.

FIG. 7*b* is a partial section view on VII—VII of FIG. 6, in which the gathering gripper is shown with the internal articulated arm in the open position; the figure shows that the internal arm 11 can rotate about the axis ZZ3 driven by the first linear cylinder 20 and the link 23; the figure also shows that the lower end of the internal articulated arm 11 and of the sweep arm 10 comprises jaws 25 in which a V-shaped indentation is worked the internal edges 25*a* of which form an angle δ, it being of advantage that this angle is about 90 degrees; when the sweep arm and the gathering gripper move on the guide (item 9 in FIG. 2) along an axis parallel to the longitudinal axis of the carrier strips, the bottom 25*d* of the V-shaped indentation in the sweep arm jaw can move along an axis XX5, it being of advantage that this axis is located at the insertion height, so as to gather the wire ends into the V-shaped indentation in the sweep arm jaw.

FIG. 7*c* is a similar view to FIG. 7*b* in which the gathering gripper and more specifically the internal articulated arm is shown in a position where it is closed around the ends of a wire section 5 which have been gathered to form a kind of strand by the particular shape of the jaws of the sweep arm and internal articulated arm 11; the internal articulated arm 11 has been closed by means of the first linear cylinder 20, which pushes rod 20*a* downwards, causing translational movement of the fork 20*b* attached to the end of the rod, the internal articulated arm being caused to rotate around the axis ZZ3 by means of the linear cylinder 20 and a link 23 one of which ends is free to rotate relative to the internal articulated arm, the other end being free to rotate relative to the fork. In the position shown in FIG. 7*c*, the internal articulated arm 11 is forming a general angle δ with the vertical, caused by the presence of the wire section 5 ends in the jaws of the internal articulated arm and the sweep arm. It is of advantage that the linear cylinder comprises a load limiting device capable of limiting cylinder travel when the wire ends are in held in the jaws, thus requiring a partial travel (an opening stroke shorter than that shown in FIG. 7*a*) when the wire ends are present.

Figure 8C:
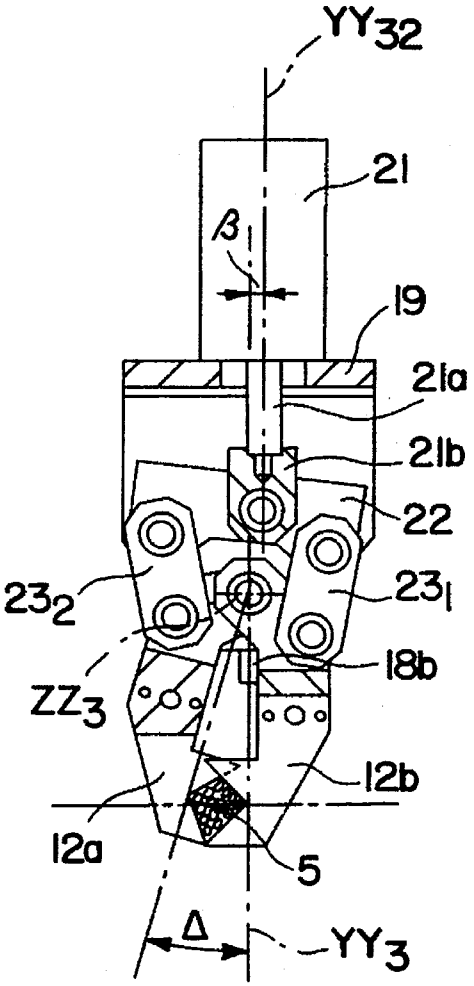
Figure 8B:
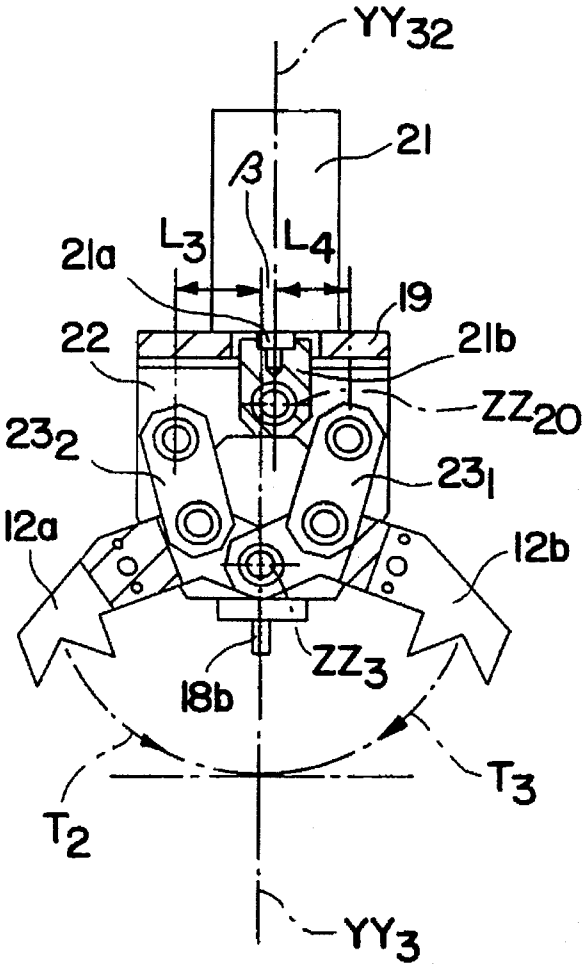
Figure 8A:
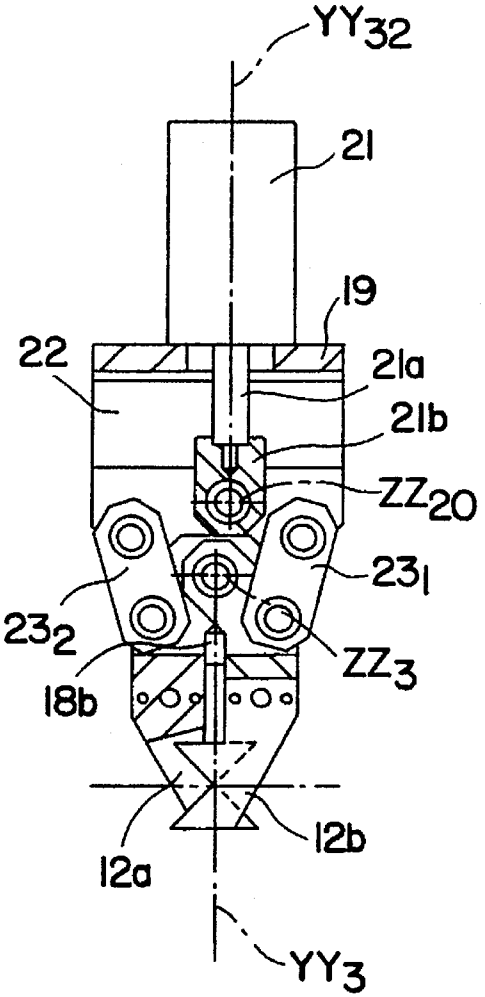

FIG. 8*a* is a partial sectional view on VIII—VIII of FIG. 6 which shows that the gathering gripper comprises the second linear cylinder 21 oriented along an axis YY32 and fitted with a rod the end of which is equipped with a fork, the fork driving links 23 one end of which is articulated onto the external articulated arms, the other end being articulated onto the beam 22 which is free to rotate relative to the fork, about an axis ZZ20; the figure, in which the external articulated arms are shown in the closed position with no wire ends gripped by the arms, also shows that the lower ends of the arms 12*a* and 12*b*, i.e. the two jaws, partly overlap.

FIG. 8*b*, which is a similar view to FIG. 8*a* showing the external articulated arms in the open position, shows that the articulation axis ZZ20 of the beam 22 relative to the fork 21*b* attached to the end of the rod of the linear cylinder 21 is offset in the plane of the figure from the general vertical axis YY3 of the gripper (this axis YY3 intersecting the articulation axis ZZ3 of the arms) by a value B which it is of advantage to have as low as possible, for example a few millimeters; on closure of the gripper, the external articulated arms are driven by the second linear cylinder 21 and follow respectively the circular trajectories T2 and T3 the centre of which is the trace of the articulation axis ZZ3 in the plane of the figure, in order to gather the wire ends situated on the external side relative to the support grippers (not shown); it also shows that the gripper body 19 also comprises a stop 18*b* which inhibits the external articulated arm travel when these arms reach the closed position. Due to the offset B between the articulation axis of the beam relative to the fork and the articulation axis ZZ3 of the arms relative to the gripper body, movement of the arms 12*a* and 12*b* will be delayed or staggered so that, as shown in FIG. 8*c*, the ends of the wire sections 5 can be gathered into a position similar to that shown in FIG. 7*c* for the internal articulated arm and the sweep arm; the figure shows the case where several wire ends have been gathered by the external articulated arms 12 as shown in FIG. 8*c*, one of the external articulated arms (on the right in the figure) having reached the stop 18*b*, the second external articulated arm (on the left in the figure) forming an angle δ similar to the angle δ of FIG. 7*c* which value may be less than 10 degrees, for example; the figures shows that in this position, the beam 22 is tilted away from the horizontal and the links $23_1$ and $23_2$ occupy a position dissymmetrical to the general vertical axis YY3 of the gripper.

Figures 9, 10, 11:
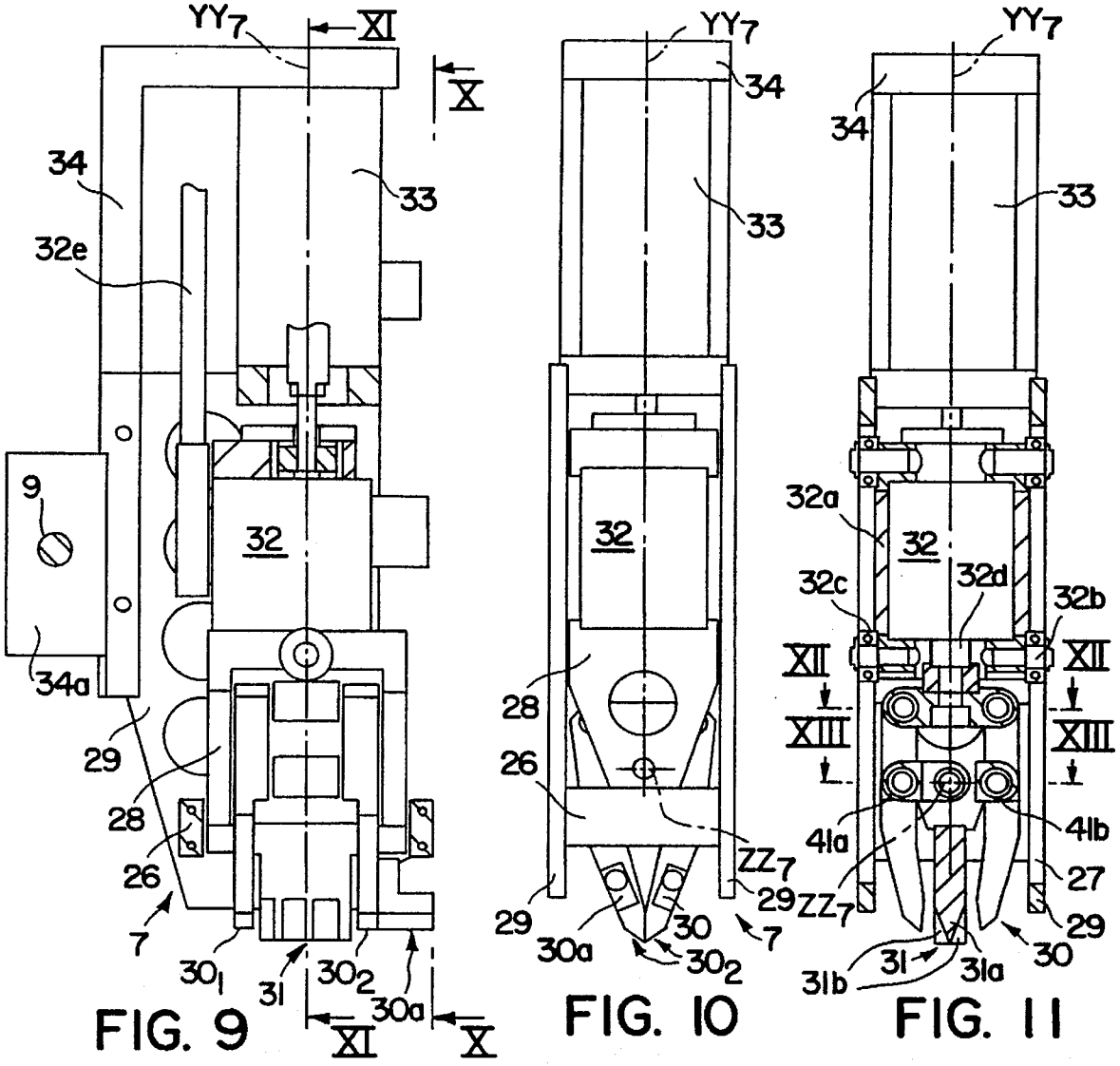
FIGS. 9 to 13 show a specific mode of embodiment of mating grippers for an apparatus according to the invention.

FIG. 9 shows a transversal view of a mating gripper according to the invention which can be moved along the guide or shaft 9, which can be of circular section, for example, by a sliding device such as a ball sleeve for example; the mating gripper comprises a support or body 34 on which is mounted a vertical movement cylinder 33; the vertical movement cylinder 33 ensures movement, relative to the mating gripper body or support 34, of an assembly comprising a cylinder which actuates claws $\mathbf{30}_1$ and $\mathbf{30}_2$ and causes simultaneous vertical movement of a mobile flange 28 relative to the body 34 fitted with flanges 34*a* connected by spacers 26. The figure also shows that, as for the gathering gripper, the internal claws $\mathbf{30}_2$ and external claws $\mathbf{30}_1$ of the mating gripper are spaced apart so as to allow the wires held by the mating gripper claws to be introduced into the claws of one of the support grippers (not shown).

It is of advantage that the lower lateral ends of the internal claws $\mathbf{30}_2$ are fitted with extensions 30*a* allowing gripping of the wire end held by the mating gripper a certain length, so as to hold the wire sections as near as possible to their ends, in order to ensure a correct hold of the wire end, which is necessary during insertion of the wire end into a component opening. FIG. 9 also shows a compressed air supply device 32*e*, of the pneumatic type for example, for supplying air to the cylinder 32 actuating the claws.

FIG. 10 shows a view on X—X of FIG. 9, in which the claws 30 are shown in the closed position whereas they were shown in the open position in FIG. 9. It shows that the assembly consisting of the cylinder 32 and mobile flanges 28 can move relative to the gripper body and relative to the fixed flanges 29 on the gripper body; this figure also shows that each internal claw $\mathbf{30}_2$ is fitted with the claw extension 30*a* ensuring correct hold of the wire section ends.

FIG. 11 is a view on XI—XI of FIG. 9 and shows that the assembly consisting of cylinder 32 and claws can move by the gripper support and fixed flanges 29 along a track 27 which can be installed in the fixed flanges 29 so as to allow movement of the above assembly through ball bearings 32*c* for example which may be mounted on pin sections 32*b* rigidly attached to the mobile assembly comprising the cylinder 32; it also shows that the jaw actuating cylinder 32 can, by means of a rod 32*d* and a fork (item 41*c* in FIG. 12) common to the claws, cause downward movement of the upper ends of the claws, the central part of the claws being attached by links respectively 41*a*, 41*b*, which are articulated around a fixed axis ZZ7 relative to the vertically mobile assembly (on mobile flanges 28), in order to approach the lower ends of the claws actuated by the cylinder 32; the figure shows that it is of advantage that a central plunger 31*a* not actuated by the claw cylinder and which is fixed relative to the vertically mobile assembly (on the mobile flanges 28), has a lower end 31*a* of triangular section with tilted sides 31*b* which separate the claws of the support gripper to allow introduction of the wire ends and also, when introducing a wire section held by the claws 30 into a support gripper, for example, makes for easier insertion of the part of the wire section situated between the claws by means of the central plunger pushing the central part of the wire section, in order to prevent distortion of the wire section and to prevent the wire section slipping out of the mating gripper claws, and to overcome the opening load of the support gripper claws.

Figure 12:
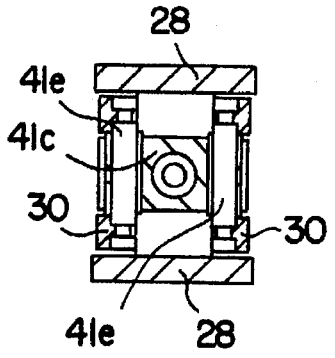
Figure 13:
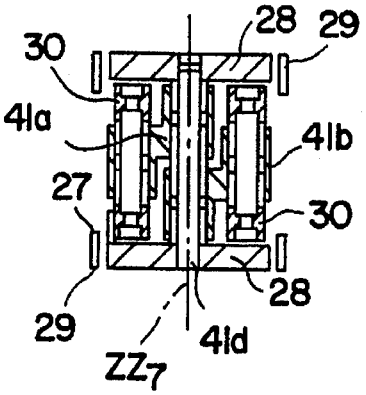

FIGS. 12 and 13 are respectively a sectional view on XII—XII and a sectional view on XIII—XIII of FIG. 11, which show that the mobile flanges 28 which are part of the vertically mobile assembly can move relative to the fixed lateral flanges 29 on which the track 27 is mounted; FIG. 13 shows that the links 41*a* and 41*b* are articulated around a pin 41*d* of axis ZZ7 which is fitted on the mobile flanges 28.

FIG. 12 shows that the claws 30 can be driven by the jaw actuating cylinder through the common fork 41*c* and two pins 41*e*.

Figure 14:
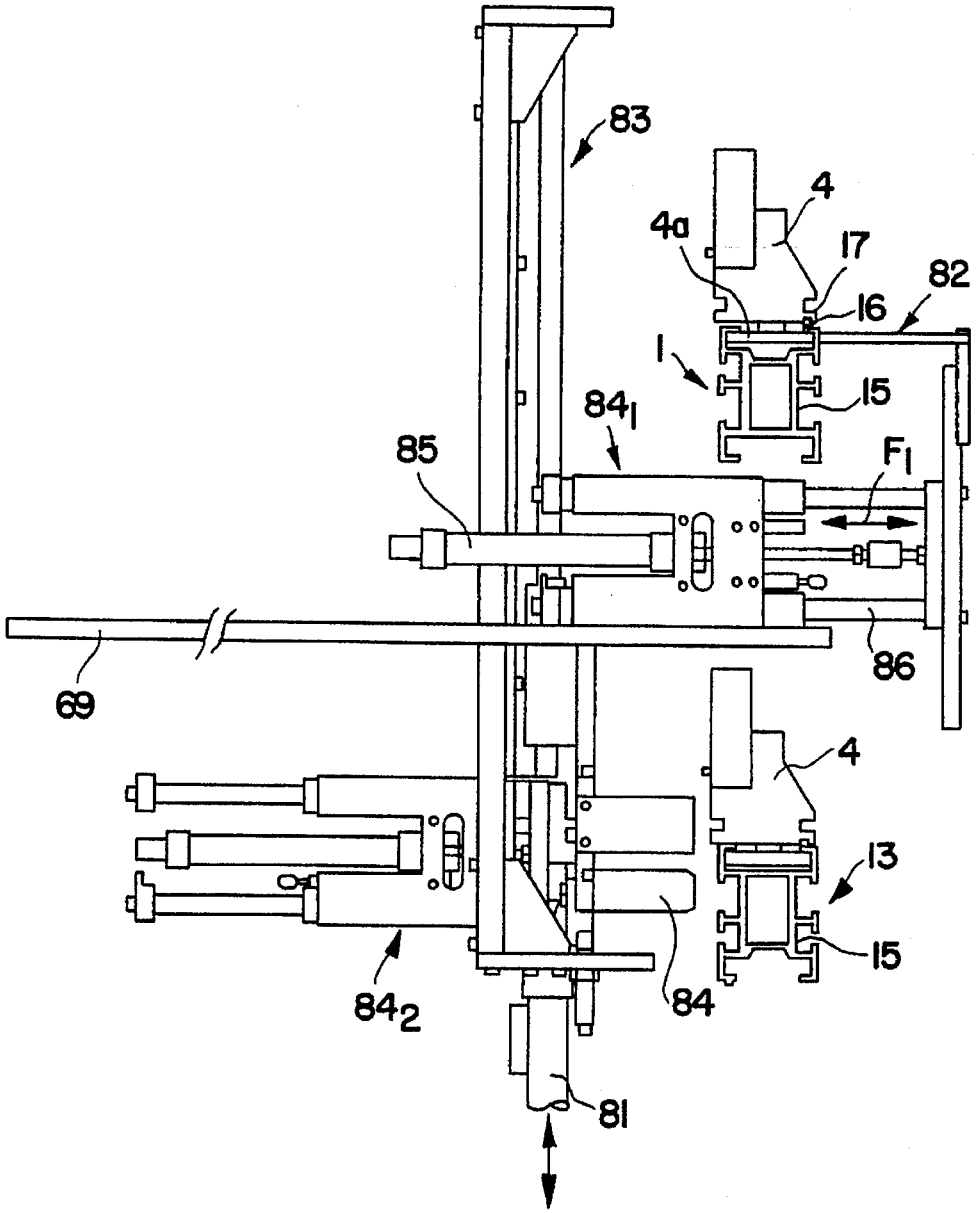
FIG. 14 shows a transversal view of a mode of embodiment of a device for transferring gripper transfers in an apparatus for manufacturing electrical cable bundles according to the invention.

FIG. 14 shows a transversal side view of the device for transferring the transfer grippers 4 from the first carrier strip 1 to the third carrier strip 13 located below the first carrier strip 1; it shows that in this preferential mode of embodiment, the first carrier strip 1 comprises a support 15 such as a metal profile for example with one of its upper lateral faces (top right in figure) having an embossed rib 16 with a triangular section, which can correspond to a recessed rib 17 worked in the lower part of the body of the transfer gripper 4; the transfer gripper is thus able to slide between the upper lateral flanges of the profile 15 by means of its base 4*a*.

This figure shows that it is of advantage that the third carrier strip 13 also comprises a support profile 15 and it is of advantage that this is identical to the profile 15 of the first carrier strip and is mounted in the reversed position for transferring the transfer grippers 4; the figure shows that the transfer gripper transfer device also known as the elevator includes a vertical guide system 83 for a sliding chock 84 which is the elevator strictly speaking and which can be moved by a vertical translation cylinder 81 located at the base of a fixed structure rigidly attached to the rigid deck 69.

The transfer gripper transfer device also includes two plunger assemblies $\mathbf{84}_1$ and $\mathbf{84}_2$; each plunger assembly comprises a cylinder 85 and a horizontal translation guide system 86 authorizing movement of the plungers 82 in the direction of the arrows F1 and which allows, for plunger assembly $\mathbf{84}_1$, the extraction of one or two transfer grippers from the first carrier strip 1, the transfer gripper then being placed on the sliding chock 84 when this is in the upper position confronting the plunger 82; the sliding chock can then be lowered by means of the cylinder 81 and the guide system 83 to the position shown in FIG. 14 where the second plunger assembly $\mathbf{84}_2$ equipped with a cylinder and horizontal guide system can push the transfer gripper(s) from the sliding chock onto the third carrier strip 13.

Figure 15A:
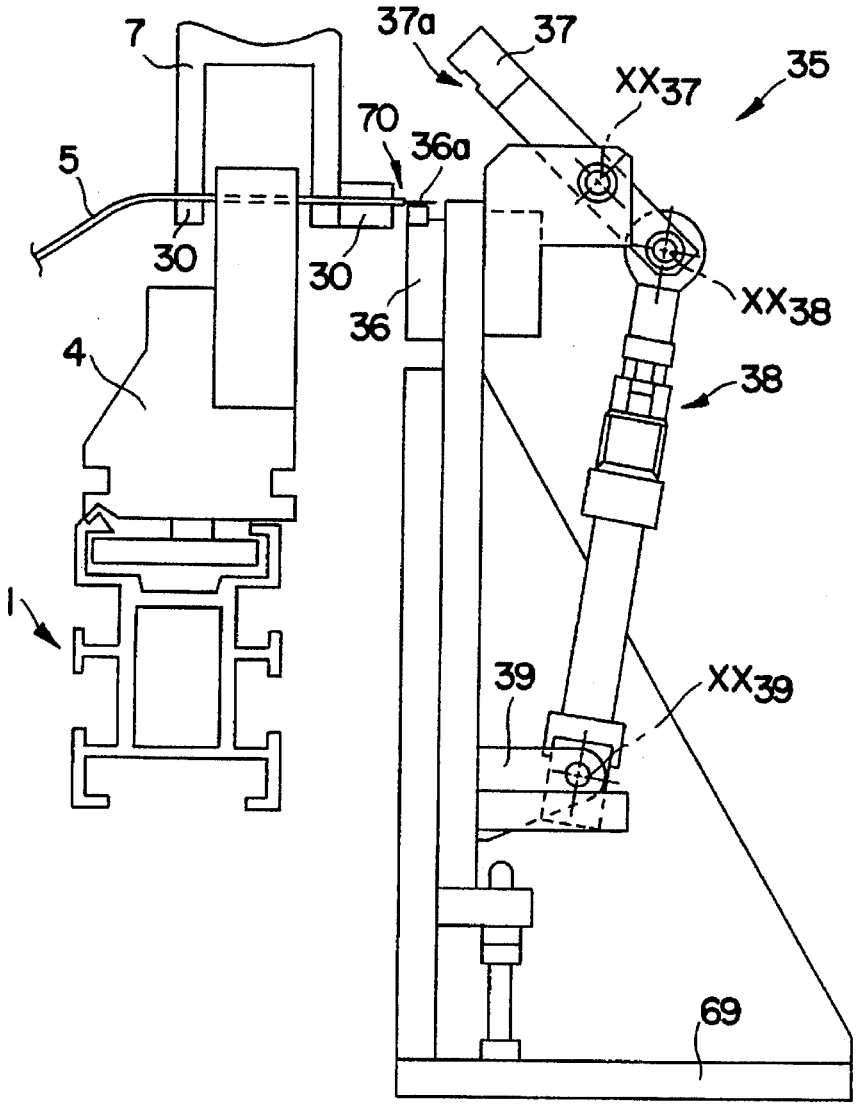
FIGS. 15*a* and 15*b* show a transversal view of a mode of embodiment of a vertical positioning device for wire ends in an apparatus for manufacturing electrical cable bundles according to the invention.

FIG. 15*a* is a transversal view showing an example of embodiment of the device for vertical positioning of the wire ends 70 held by the transfer gripper 4 which ensures vertical positioning prior to gripping of the wires by the mating grippers 7.

Figure 15B:
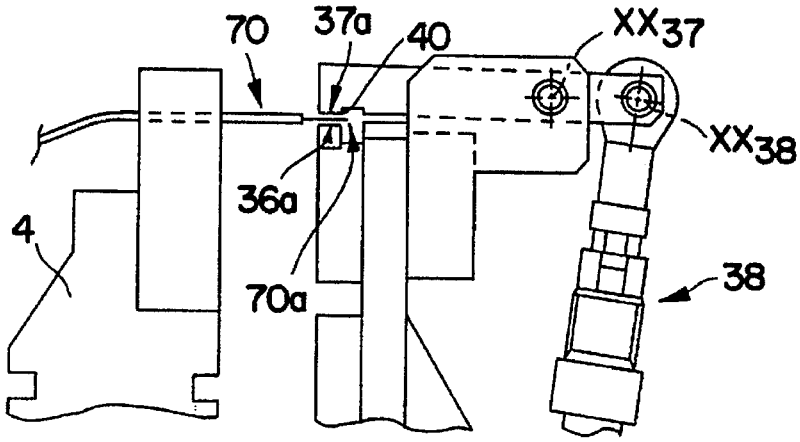

The figure shows that in this mode of embodiment, the vertical positioning device 35 comprises, mounted on the fixed deck 69, a cylinder 38 articulated about a fork 39 of axis XX39, the vertical position of which can be adjusted relative to the fixed deck 69; at the upper end of the cylinder 38, a mobile plate 37 articulated around an axis XX37 is moved by its end connected to the cylinder 38 through an articulation about an axis XX38 which causes upwards or downwards movement of its internal face 37*a* according to a circular trajectory along the axis XX37; FIG. 15*b* shows roughly the same view as FIG. 15*a* in a phase where, before the wire ends 70 held in the transfer gripper 4 are gripped by the mating grippers (not shown), the previously stripped or prepared wire ends 70*a* are positioned vertically by lowering the mobile plate 37 the internal face 37*a* of which corresponds with the internal face 36*a* of a fixed plate 36, and defines a blade shaped space with parallel faces which is thicker than the thickness of the stripped part of the wire end, thus ensuring vertical positioning of the wire end by closure to a predetermined position of the mobile plate which is actuated by the cylinder 38 and articulated around an axis XX37; FIG. 15*a* shows that in the next phase, the claws 30 of the mating gripper 7 can now grip the the end 70 of the wire section 5 held by the claws of the transfer gripper 4 situated on the first carrier strip 1 in a position in which the wire end has been positioned to a predetermined height by the vertical positioning device 35, then the cylinder 38 has been actuated in order to raise the mobile plate 37.

Figure 16:
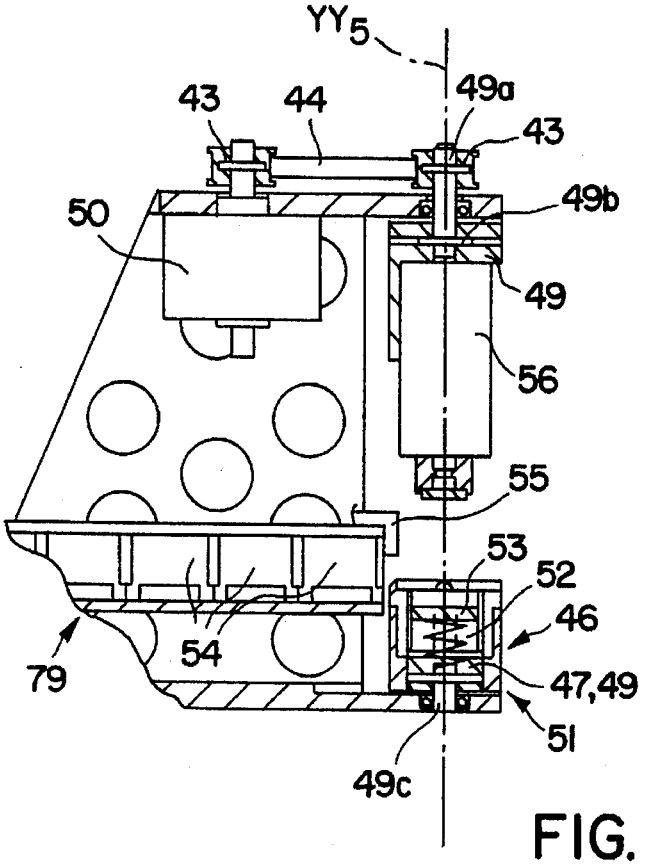
FIGS. 16 and 17 show a particular mode of embodiment of an insertion device.
Figure 17:
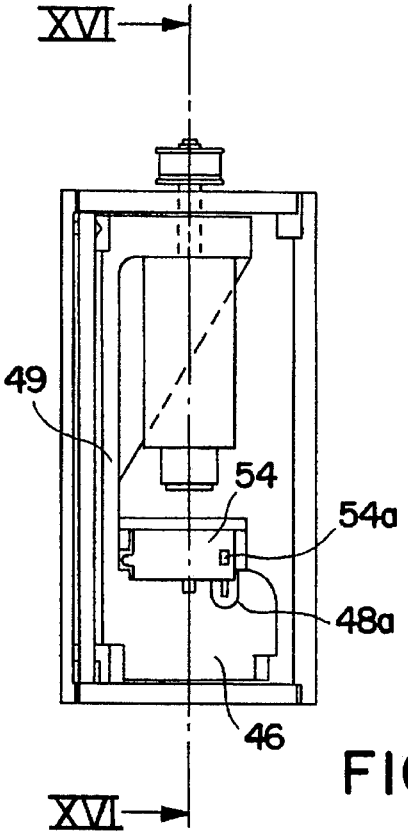

FIGS. 16 and 17 show a preferential mode of embodiment of part of the insertion device comprising the mobile insertion support 51; FIGS. 16 and 17 show that the clamping cylinder 56 and the mobile insertion device 51 are mounted on a support 49 which can be rotated about a vertical axis YY5 by a rotary cylinder or motor 50 through a drive system comprising in particular two pulleys 43, a drive belt 44, and a first shaft 49*a* which is immobilized on the support 49 by a key 49*b* for example, and by a second shaft 49*c* which ensures rotation of the lower part of the support 49 and the mobile insertion device 51 about the axis YY5; the figures show that, as described above, the mobile support 51 includes the mobile plate 53 which can move vertically duping clamping and unclamping operations, this mobile plate being fitted on a spring 52 which can distort along the vertical axis YY5, and guides 48*a* on the side walls 46 of the mobile insertion device align the wire ends with the openings 54*a* in the components 54.

Figure 18A:
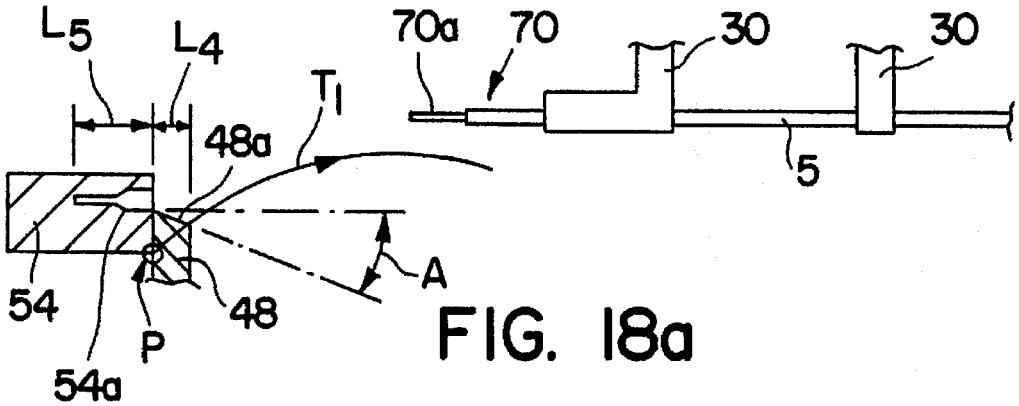
FIGS. 18*a* to 18*d* show the operations of a process to insert wire ends into openings in components according to the invention.
Figure 18B:
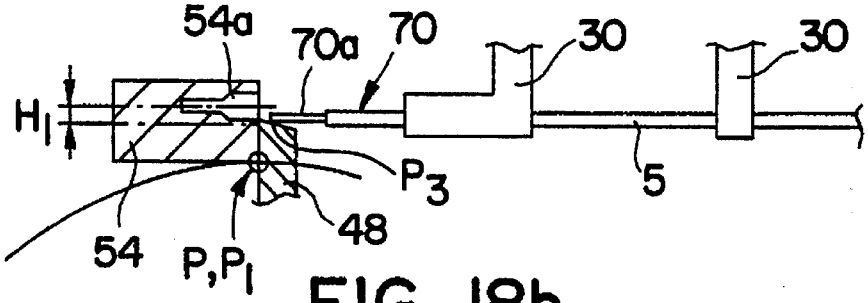

FIGS. 18*a* and 18*b* show very schematically the operations involved in the insertion process according to the invention. FIG. 18*a* shows that a point P linked to the components 54 having at least one opening 54*a*, follows a circular trajectory T1 duping the insertion phase; it shows that the mating gripper claws (partly and schematically shown) are holding the wire section 5 by its end 70 part of which 70*a* has been stripped; it shows that it is of advantage that the component 54 is mounted on the mobile insertion support (not shown), which mobile insertion support is fitted with the guide 48 having one guide face 48*a* to guide the wire section into the opening during the insertion operation; the guide face 48*a* can form an angle A of approximately 20 degrees with the insertion direction, the guide 48 being of thickness L4 and the opening 54*a* having a depth L5.

FIG. 18*b* shows that in a preferential mode of embodiment of the insertion process, when point P relative to the component reaches the apogee P1 of the curved insertion trajectory, the wire end comes into contact with the guide face located nearest to the opening at a median point P3 of the surface of the guide, such that the horizontal axis of the wire end is offset by a height H1 from the horizontal axis of the opening into which the wire end is to be inserted.

Figure 18C:
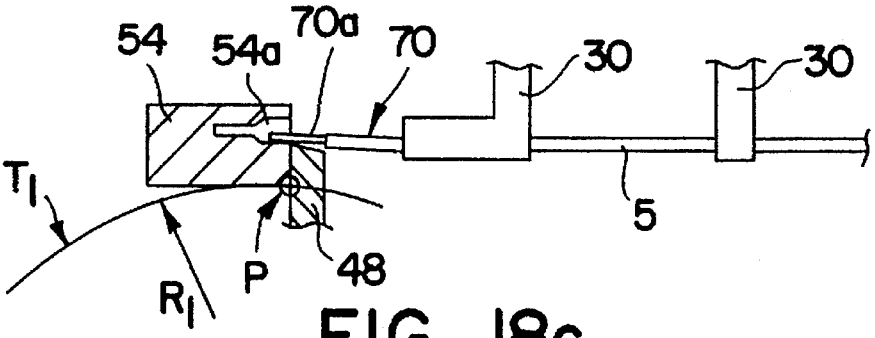

FIG. 18*c* shows that point P relative to the component has passed the apogee of the trajectory T1 or radius R1 and the wire end is being inserted into the opening.

Figure 18D:
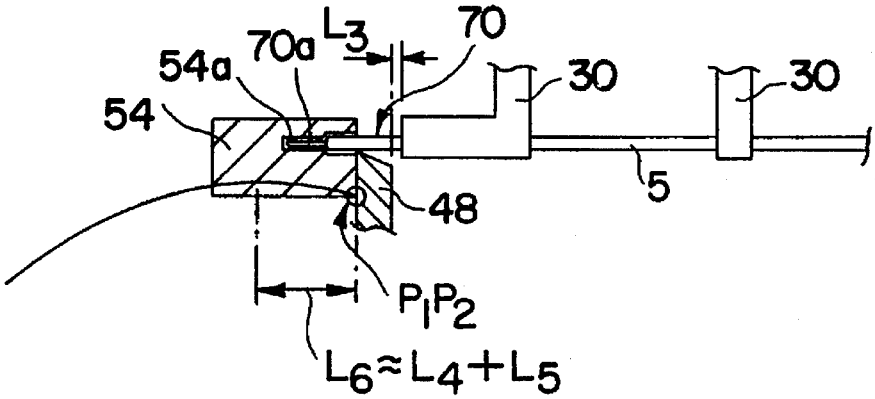

FIG. 18*d* shows the end of the operation to insert the wire end into the opening, in which point P relative to the component has reached the end point P2 of the trajectory, the distance L6 between this end point and the apogee P1 in the plane of the curved trajectory, along a direction parallel to the direction of the wire section, being approximately equal to the sum of the values L4 and L5; the figure shows that it is of advantage that in this position, the distance L3 between the front face of the mobile insertion support guide and the end of the internal claw of the mating gripper is very small, around one millimeter.

We claim:

1. An apparatus for inserting a wire end into an opening of a component to assemble the wire and the component, the apparatus comprising: mating grippers for holding the wire; an insertion support for holding the component; and moving means for moving said insertion support along a curved trajectory relative to said mating grippers during insertion of the wire end into the opening of the component, wherein the relative movement between the end of the wire held by said mating grippers and the component held by said insertion support is along a curved trajectory as the wire end is inserted into the opening of the component.

2. An apparatus according to claim 1, the mating grippers having claws for holding the wire end, wherein said curved trajectory is made up of an arc of a circle situated in a plane containing an axis along which is oriented the wire end held by said claws of said mating grippers.

3. An apparatus according to claim 1, further comprising an insertion device with an end guide for guiding the wire end in the opening of the component, said insertion device having a plate for receiving the component, which plate is rotatable about a vertical axis, said insertion device having a linear cylinder for clamping the component on said insertion device.

4. An apparatus according to claim 1, wherein said moving means includes a horizontal mobile deck interconnected to a horizontal fixed deck by parallel links pivotably coupled to the decks to form a deformable parallelogram.

5. An apparatus according to claim 1, further comprising an insertion device mounted on a horizontal mobile deck.

6. An apparatus according to claim 1, further comprising a feed actuator for moving the component along a feed guide toward an insertion device.

7. A process for inserting a wire end in an opening of a component, the process comprising steps of:

disposing the wire end in a claw of a mating gripper;

moving the mating gripper to position the wire end in a plane containing an axis of the opening of the component, the component held in a mobile insertion support; and moving the component and the mobile insertion support along a curved trajectory while inserting said wire end in the opening of the component.

8. A process according to claim 7, wherein the wire end comes into contact with a median zone of a guide face when a point on the component reaches an apogee of the curved trajectory, and then insertion of the wire end proceeds as the component is moved along the curved trajectory.

9. An apparatus for manufacturing electrical cable bundles having at least one wire with a wire end assembled with a component having at least one opening, the apparatus comprising:

at least a pair of transfer grippers for holding a wire;

a first linear carrier strip for conveying the transfer grippers along the carrier strip;

a preparation stations positioned along the carrier strip for processing the wire ends, one of said preparation stations including mating grippers for removing the wire from said transfer grippers and for holding the removed wire;

a mobile component support for holding the component; and means for moving the component held by said mobile component support along a curved trajectory from a position remote from said mating grippers to a position proximate said mating grippers, wherein the relative movement of the end of the wire held by said mating grippers and the component held by said mobile component support is along a curved trajectory as the wire end is inserted into an opening of the component.

10. An apparatus according to claim 9, wherein said curved trajectory is in a plane.

11. An apparatus according to claim 9, wherein said curved trajectory is in a vertical plane.

12. An apparatus according to claim 9, wherein said curved trajectory is made up of a circle situated in a vertical plane.

13. An apparatus according to claim 9, wherein said means for moving the component held by said mobile component support comprise a mobile deck connected to a fixed deck by parallel links pivotably coupled to the decks.

14. An apparatus according to claim 9, wherein said curved trajectory is made up of an arc of a circle.

* * * * *